US005292109A

United States Patent [19]

Bebber et al.

[11] Patent Number: 5,292,109

[45] Date of Patent: Mar. 8, 1994

[54] DEVICE FOR COUPLING THE CURRENT FEED TO A METALLURGICAL VESSEL

[75] Inventors: Hans J. Bebber, Mülheim; Bernhard Espendiller, Dülmen; Klaus Giertz, Bochum; Ulrich Katschinski, Mülheim, all of Fed. Rep. of Germany

[73] Assignee: Mannesmann Aktiengesellschaft, Dusseldorf, Fed. Rep. of Germany

[21] Appl. No.: 851,014

[22] Filed: Mar. 13, 1992

[30] Foreign Application Priority Data

Mar. 14, 1991 [DE] Fed. Rep. of Germany ..... 4108583

[51] Int. Cl.[5] ..... H05B 7/02

[52] U.S. Cl. ..... 266/242; 266/275; 373/102

[58] Field of Search ..... 266/242, 275; 373/102, 373/103, 147

[56] References Cited

U.S. PATENT DOCUMENTS 3,198,869 8/1965 Sixel ..... 373/103

4,682,341 7/1987 Ehle et al. ..... 373/103

FOREIGN PATENT DOCUMENTS 0115447 9/1979 Japan ..... 373/147

*Primary Examiner*—Scott Kastler

*Attorney, Agent, or Firm*—Cohen, Pontani, Lieberman, Pavane

[57] ABSTRACT

A device for coupling a flexible current feed (50) to a bottom electrode of a metallurgical vessel (10) having a first electrical coupling (20), including a second electrical coupling (30) for operatively engaging the first coupling (20), being connected to the current feed (50), a carrier element (60) and a compensating element (40) between the carrier element (60) and the second electrical coupling (30), the compensating element (40) balancing a force of the flexible current feed (50) on the first electrical coupling. The compensating element (40) may include a damper (42) in parallel to a spring (41), so that a movement of the second electrical coupling (30) with respect to the carrier element (60) is damped.

15 Claims, 3 Drawing Sheets

DEVICE FOR COUPLING THE CURRENT FEED TO A METALLURGICAL VESSEL

FIELD OF THE INVENTION

The present invention relates to a device for the coupling of a bottom electrode arranged in a metallurgical vessel with a flexible current feed which is connected to a power supply system.

BACKGROUND OF THE INVENTION

In the metallurgical industry, metallurgical vessels are used which are heated by means of direct current (DC) electricity. In this method, the cathode generally extends into the vessel and the anode is arranged on the bottom of the vessel. The electrical connection device for linking the vessel to a power source, in particular in ladle handling stands and in tundish heating systems, is subject to frequent actuation.

In such a device, the anode can be formed as an individual electrode, for instance as a metallic bar electrode. The lining of the vessel may also be formed of an electrically conductive material so that the vessel or a part thereof forms the anode, and the wall of the vessel is thus used for conducting electrical current.

When the metallurgical vessel is replaced, or when an anode is changed in the event that it has become worn out, the current feed must be detached at a terminal.

European Patent Application No. EP-OS 0,133,931, discloses a threaded connection for the anode connection below the vessel. The disclosed structure has the disadvantage, however, that servicing personnel must manually detach the bottom connection by hand.

European Patent Application No. EP-OS 0,275,384, discloses a connection system having spring-actuated support pins as the contact device. These pins act by pressing the current feed line against the electrode, which are retracted upon the loosening of the electrical contacts in the event of service. The current supply cables are in this case fastened to displaceable straps, which are pivotally mounted.

In the contact device of EP-OS 0,275,384, the tensile or pulling forces resulting from the weight of the current feed line itself, act on the bottom electrode, causing a stress. Furthermore, there is no system or method provided to allow the mechanized introduction of the current feed cable.

Federal Republic of Germany Patent No. DE 0,178,981, discloses a connecting terminal for an electrode of a metallurgical vessel, in which a suspension flange, which holds the electrode, is connected by telescopic arms to the outer wall of the vessel. Elastic elements arranged in the telescopic arms serve to compensate for thermal changes in the length of the electrode. In this device, the electrode is acted on by various pressure forces. The current feed is attached by a threaded flange to the protruding part of the electrode, and can be detached only manually.

European Patent Application No. EP OS 0,344,092, discloses a metallurgical vessel having an opposing electrode, having on its outer shell an element which serves for the transmission of the electrical energy and has a surface which rests on the surface of an opposing element. This opposing element can be positioned by mechanical means.

The system of EP OS 0,344,092 has the disadvantage that, when supported, both elements are acted on by compressive forces, either along the vertical or horizontal axes, depending on the arrangement. By the disclosed use of mechanical means for positioning and adjusting, fixation of the electrode in the desired operating position is possible only within narrow limits.

OBJECTS OF THE INVENTION

It is an object of the present invention to provide a device which creates an electrical contact connection between an electrode and a current supply system which, while being of simple construction, can be positioned within a wide region and permits mechanized connection, the contact being maintained in a force-neutral fashion with the reliable transmission of current.

It is another object of the invention to provide a device for coupling a flexible current feed connected to a current supply unit to a bottom electrode arranged in a metallurgical vessel, having couplings (20) provided on the metallurgical vessel (10) which can be mated with coupling parts (30) of the feed, having compensating elements (40) connected to a carrier element (60), being arranged in a manner so as to permit a force-free guidance of a forward region (51) of the flexible current feed (50) into a coupled position.

It is another object of the present invention to provide a device for coupling a flexible current feed (50) to a bottom electrode of a metallurgical vessel (10) having a first electrical coupling (20), comprising a second electrical coupling (30) for operatively engaging the first coupling (20), being connected to the current feed (50), a carrier element (60), and a compensating element (40) between the carrier element (60) and the second electrical coupling (30), the compensating element (40) balancing a force of the flexible current feed (50) on the first electrical coupling. The compensating element of such a device may be a spring, or a spring in parallel with a damper.

It is another object of the present invention to provide a coupling in which the compensating elements (40) are springs (41).

It is a further object of the present invention to provide a coupling in which the compensating elements (40) are dampers (42) which are provided in parallel with springs (41).

It is a still further object of the present invention to provide a coupling in which the compensating elements (40) are cylinder-piston units (43) which are displaceable by a fluid.

It is yet another object of the present invention to provide a coupling having cylinder-piston units (43) in which the cylinder-piston units (43) are connected to a pump (72) via feed and discharge lines (73, 74).

It is a still further object of the present invention to provide a coupling in which the carrier element (60) has an arm attached to a vertically displaceable mount (61).

It is another object of the present invention to provide a coupling having, for the vertical movement of the carrier arm (60), a drive (70) connected to the piston-cylinder unit (43) and controlled by a controller (80).

Another object of the present invention is to provide a coupling in which the carrier arm (60) has a mount (62) for horizontal movement and a mount (61) for vertical movement.

It is yet another object of the present invention to provide a coupling in which the coupling parts (20, 30) form a sleeve coupling.

A further object of the present invention is to provide a coupling in which a male part (21) of the coupling part (20) is arranged on the metallurgical vessel (10), having a conical outer shape which corresponds to the female part (31) of the coupling part (30) connected to the carrier arm (60).

A still further object of the present invention is to provide a coupling having a male and a female part in which the female part (31) is fastened to a support (48) developed as a balance beam and is arranged in an angularly moveable manner on the compensating element (40).

Another object of the present invention is to provide a coupling having a male part and a female part in which the male part (21) of the sleeve coupling (20) is connected with the support element (60) and has an axially moveable rod (22), which permits a radial alteration in a size or radius of the front region (26) of the male part (21).

It is yet another object of the present invention to provide a coupling having a male and a female part in which the front region (26) of the male part (21) can be introduced into the sleeve of the female part (31), the sleeve being arranged on the metallurgical vessel and having a conical shape tapering towards the mouth thereof.

It is another object of the present invention to provide a coupling having a male part and a female part in which the male part (21) and the rod (22) are constructed as a piston-cylinder unit (23).

It is still another object of the present invention to provide a coupling in which a spring (25) is arranged between a piston (24) of the piston-cylinder unit (23) and the male part (21).

It is yet another object of the present invention to provide a coupling having a pump (78) connected via feed and discharge lines (76, 77) to the piston-cylinder unit (23).

It is an object of the present invention to provide a coupling in which a current tab (32) is provided on the sleeve coupling between the coupling parts (20, 30).

All of these objects and others will be apparent from the summary and detailed description of the invention. It should also be understood that the various objects may be combined in any consistent way and still be within the explicit scope of the present invention.

SUMMARY OF THE INVENTION

In accordance with the present invention, a part of the coupling, to which the current feed line is connected, is attached by a compensating or balancing element to a support element. The support element can be movable or fixed in position. If the support element is fixed in position, the coupling unit attached thereto is also fixed in position, and thus only the metallurgical vessel is freely moveable. The support element can be formed as an arm. In the event that the arm is movable, the arm serves to position the coupling part attached to it with the corresponding coupling part arranged on the metallurgical vessel.

Compensating elements are employed which, after the coupling parts have been mutually engaged, compensate for the forces generated due to the weight of the flexible current feed and possibly other forces that may be present. By separating the functions of the electrical coupling from the guiding of the current feed line, the electrode and the metallurgical vessel are, in accordance with the present invention, kept free from interfering tensile or compressive forces.

A preferred embodiment of the coupling of the present invention, which requires little maintenance and operates reliably, is a sleeve coupling which includes both a male part and a female part. These parts can be connected in force-locked (frictionally fitting) or form-locked (mechanically interfitting) manner for the dependable and reliable transmission of current. A further preferred embodiment of the present invention incorporates a female coupling part having a conical shape which tapers inwardly towards the mouth. Into this female coupling part there can be introduced a male coupling part, the diameter of which can conform to the contour of the sleeve and thus increase radially in its distal region. In operation, the two coupling parts can be pressed against each other over a large area, thus forming a reliable electrical connection. In such a case, the male coupling part must also have a configuration which allows insertion into the female coupling part.

In another embodiment of the present invention, current tabs are arranged between the male part and the female part of the coupling. These current tabs help to establish the reliable electrical connection.

The coupling part present on the metallurgical vessel, in the case of a sleeve coupling, can be either a male part or a female part, which can be arranged at any desired place on the metallurgical vessel. In rough mill operation or otherwise hostile environments a position which is protected from dirt, heat and mechanical destruction or interference is desirable. This position will preferably be at or near the edge of the vessel, above the rim, as shown in FIG. 1, and may also be below the rim. Alternatively the male part or the female part of the coupling can, in turn, be fastened to the vessel proper.

The present invention is also applicable to metallurgical vessels which carry out a movement stroke during normal operation, such as, for instance, distribution troughs or the like. In such a case, controllable compensating elements can be used to compensate for the movement of the vessel. This compensation may be based on the predicted movements or incorporate feedback to detect the actual movements of the vessel. The compensating element may be a passive system, a controlled passive system, e.g., adjustable damping, or on an active system, as well as other types known in the art. These compensating elements, which are formed, for example, of hydraulic piston cylinders, are so controlled and adjusted, in accordance with the present invention, so as to produce a force-free guidance, within the entire range of the stroke, with respect to frequency and amplitude, i.e., providing both static and dynamic compensation. Thus, the compensating elements act to balance to forces present at the coupling parts during the stroke.

BRIEF DESCRIPTION OF THE DRAWING

The preferred embodiments are shown by way of example in the accompanying drawings in which.

DETAILED DESCRIPTION OF THE PREFERRED EMBODIMENTS

Figure 1:
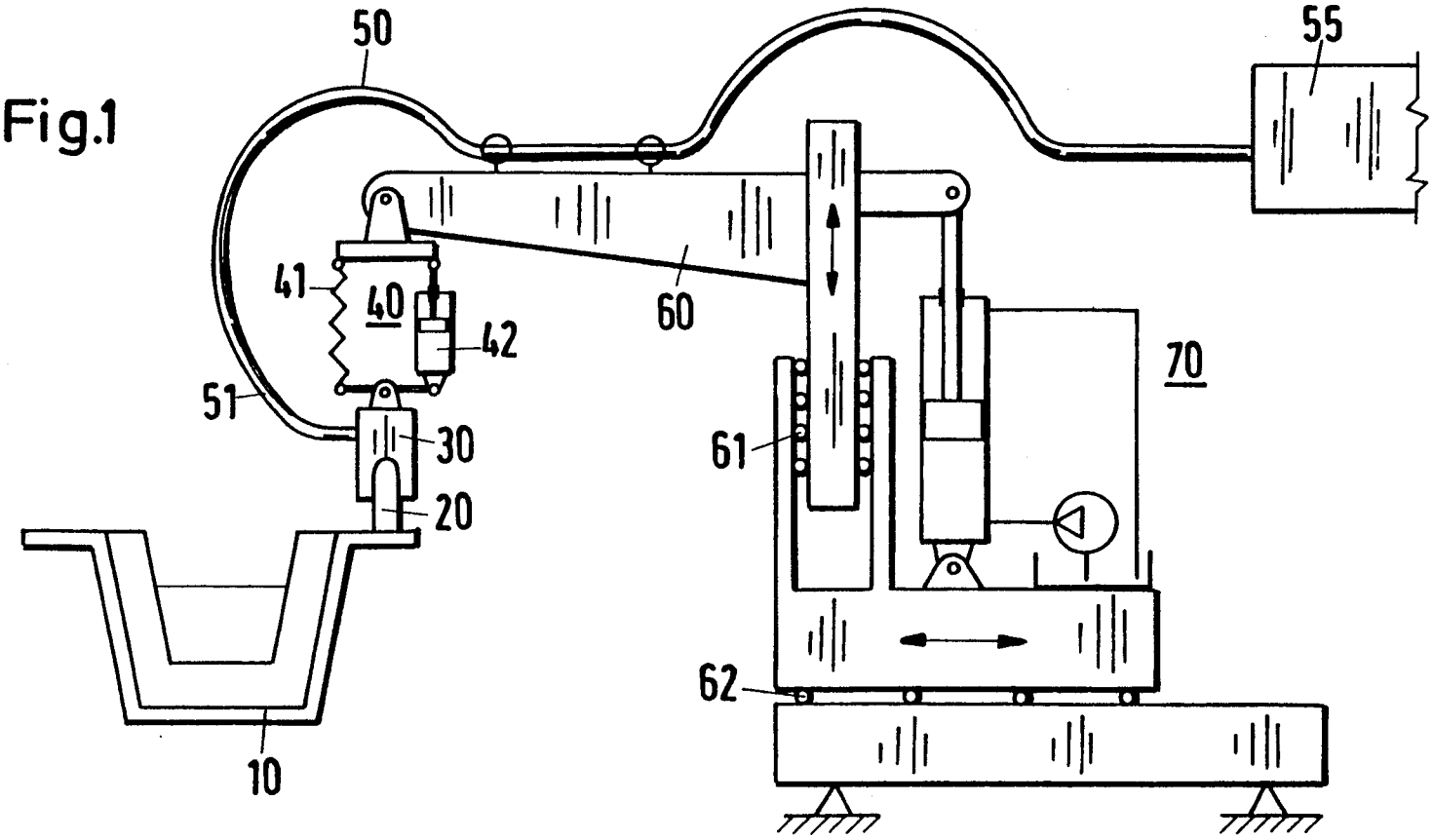
FIG. 1 shows schematically a coupling device of the present invention with a removable support arm.

FIG. 1 shows a vessel 10, on which a coupling part 20 is provided. The coupling part 20 is coupled to a corresponding coupling part 30, which is connected via a current cable 51 of the current feed 50 line to a current supply unit 55.

The coupling part 30 is further connected to a compensating element 40 which is arranged on a carrier element 60. The compensating element 40 has, shown diagrammatically, a spring 41 and a damper 42, which act in known manner as a mechanical filter to damp vibrations. The compensating element may also be of other known types, which functions to compensate for the force due to the current feed cable (50) or its related equipment, which would otherwise act on the coupling part of the metallurgical vessel. Advantageously, the compensating element may not only compensate for static forces, but may also act to reduce the effects of dynamic changes in the forces that may be due to movement, etc. Of course it should be understood that a small amount of force may be applied to the coupling without substantial deleterious effect, and therefore it may be advantageous to compensate only for those forces which would cause substantial deleterious stresses on the coupling and vessel. By limiting the compensation to major forces, the compensating element may operate more efficiently. Determination of both the force to be compensated as well as any discrimination between forces to be compensated and those which may be safely ignored may be performed in known manner.

The carrier element 60 is developed as carrier arm which is moveable in two axes as shown in FIG. 1. A vertical mounting 61 is provided for vertical movement, and a horizontal mounting 62 is provided for horizontal movement. The vertical movement of the support arm 60 is effected via a drive 70, shown schematically as a hydraulic cylinder. The horizontal mounting 62 may be displaced in known manner.

Figure 2:
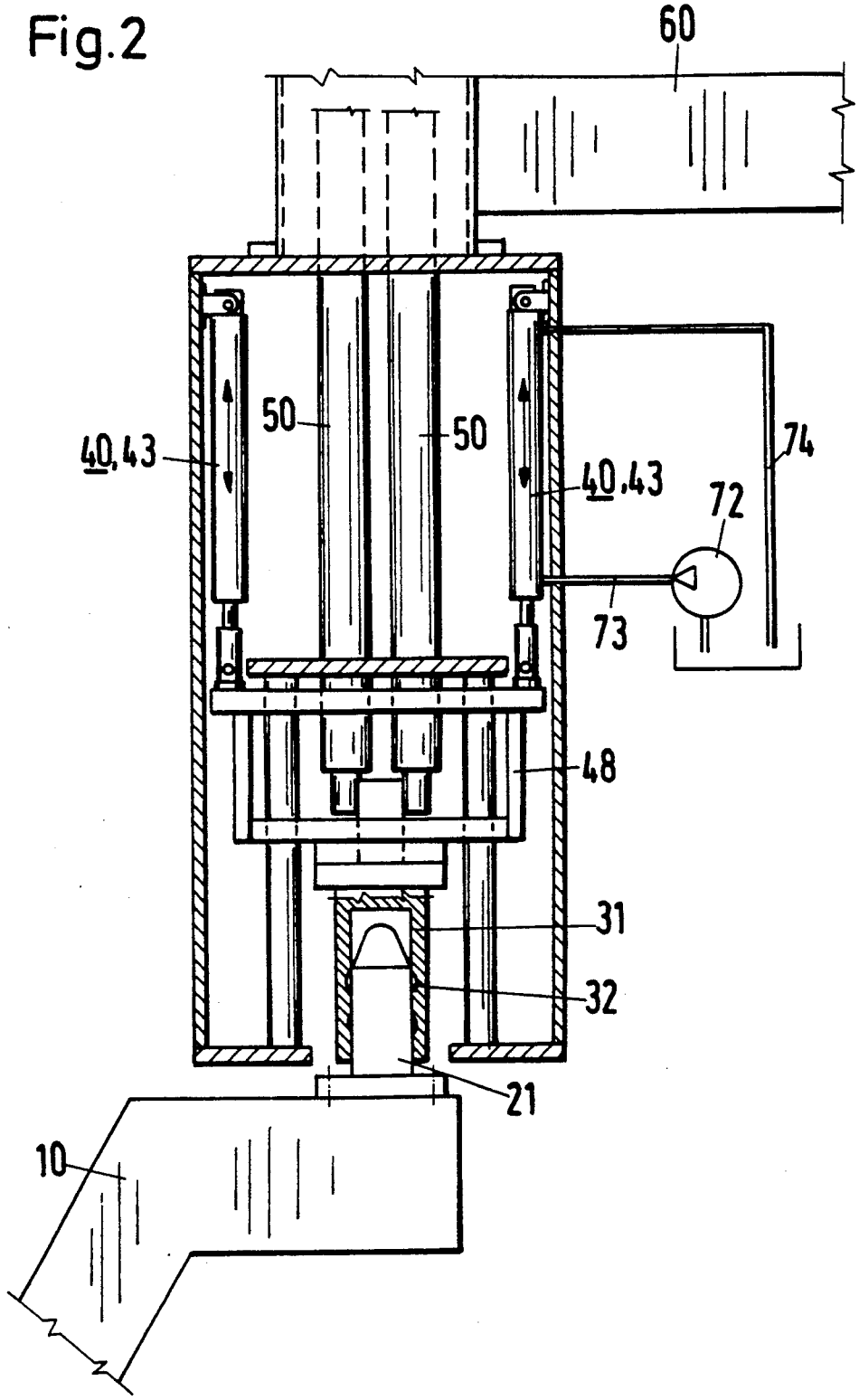
FIG. 2 shows a schematically a coupling device of the present invention with a compensating device.

FIG. 2 shows a second embodiment of the present invention in which a male part 21 is arranged on the vessel 10. The male part 21 is introduced into a female part 31 to form the coupling. A current tab 32 or contact element is arranged in this embodiment, between the male part 21 and the female part 31. The female part 31 is fastened on a balancing beam 48 of the compensating element 40, which is angularly or pivotally movable thereon, which in turn is connected to the carrier element 60 via a piston-cylinder unit 43.

A discharge line 74 and a feed line 73 connected to a pump 72 lead to the piston-cylinder unit 43.

The female part 31 is supplied with electrical energy via the current feed 50 line or cable.

Figure 3:
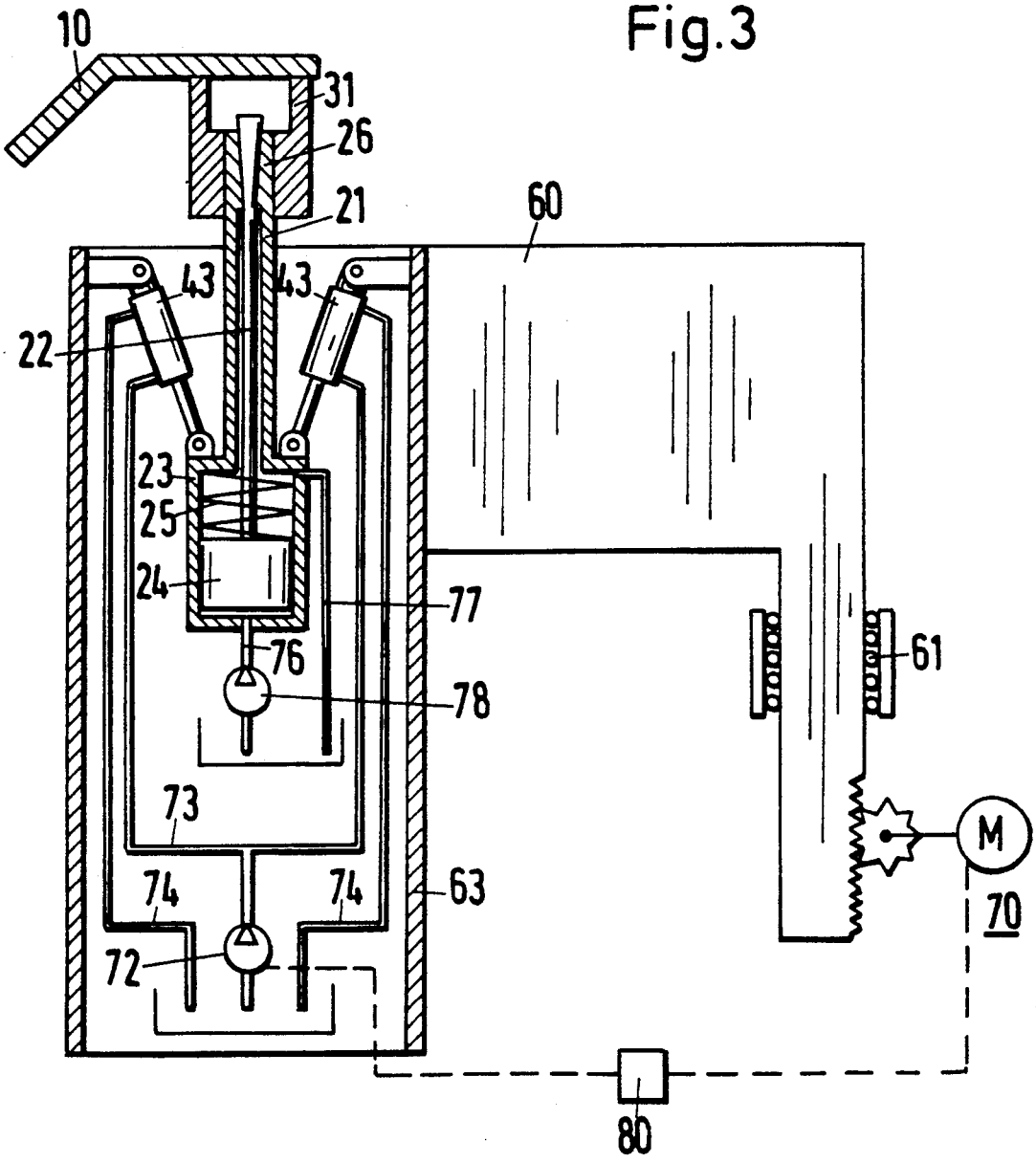
FIG. 3 shows schematically a sleeve coupling of the present invention with a clampable male part.

FIG. 3 shows a third embodiment of the present invention in which the female part 31 is arranged under the rim of the vessel 10. The conically inward toward the mouth tapering shape of the female part 31 is not shown in the diagrammatic view shown in FIG. 3. The distal region 26 of the male part 21 can be introduced into the female part 31. The male part 21 is formed of a tube, and has, located within the tube, an axially displaceable rod 22. The rod 22 is connected to a piston-cylinder unit 23, a spring 25 being provided between a piston 24 of the piston-cylinder unit 23 and a junction of the cylinder with the tubular male part 21. This spring (25) provides a return force to the piston (24), the rod (22), and when extended, may radially outward extend a portion of the male part 21, to securely engage the coupling. The piston-cylinder unit 23 has a feed line 76 provided with a pump 78, which is in communication with a discharge line 77.

The piston-cylinder unit 23 is connected to the carrier element 60 by piston-cylinder units 43. The carrier element 60 has a protective shield 63 in its front region.

Discharge lines 74 and feed lines 73, which are in communication with a pump 72, extend to the piston-cylinder units 43.

The pump 72 is connected for control via a controller 80 to a motor 70. The motor 70 allows the vertical displacement of the carrier element 60. Vertical bearings 61 are provided for guidance of the displacement of the carrier element 60 along the vertical axis.

It should be understood that the preferred embodiments and examples described are for illustrative purposes only and are not to be construed as limiting the scope of the present invention, which is properly delineated only in the appended claims.

What is claimed is:

1. A device for coupling a flexible current feed (50) to a bottom electrode of a metallurgical vessel (10) having a first electrical coupling (20), comprising:
   - a second electrical coupling (30) for operatively engaging the first coupling (20), being connected to the flexible current feed (50);
   - a carrier element (60); and
   - a compensating element (40) between said carrier element (60) and said second electrical coupling (30), said compensating element (40) balancing a force of the flexible current feed (50) on the first electrical coupling said compensating element (40) comprising a hydraulic cylinder (43) which is displaceable by a fluid.

2. The coupling according to claim 1, wherein said compensating element (40) comprises a spring (41).

3. The coupling according to claim 2, wherein said compensating element (40) comprises a damper (42) in parallel to said spring (41), so that a movement of the second electrical coupling (30) with respect to the carrier element (60) is damped.

4. The coupling according to claim 1, further comprising a pump (72) connected to said hydraulic cylinder (43) via feed and discharge lines (73, 74) for displacing said hydraulic cylinder (43).

5. The coupling according to claim 1, wherein said carrier element (60) comprises a vertically displaceable arm.

6. The coupling according to claim 5, further comprising a piston-cylinder (43), connected between said vertically displaceable arm and said second electrode 21, and a drive connected to said vertically displaceable arm, for raising and lowering thereof, being connected for control (80) to the piston-cylinder unit (43).

7. The coupling according to claim 5, further comprising a horizontally displaceable mount (62) for said carrier arm (60).

8. A device for coupling a flexible current feed (50) to a bottom electrode of a metallurgical vessel (10) having a first electrical coupling (20), comprising;
   - a second electrical coupling (30) for operatively engaging the first coupling (20), being connected to the flexible current feed (50);
   - a carrier element (60); and
   - a compensating element (40) between said carrier element (60) and said second electrical coupling (30), said compensating element (40) balancing a force of the flexible current feed (50) on the first electrical coupling, wherein said second electrical coupling (20) forms a sleeve coupling with the first electrical coupling (30), and wherein the first electrical coupling is a male coupling part (21) situated on a metallurgical vessel (10), having a conical outer shape, and said second electrical coupling is a female coupling part (31) connected to said carrier arm (60), having an inner contour, said inner contour corresponding to the conical male coupling part (21).

9. The coupling according to claim 8, further comprising a support having a pivotally movable balance beam connected to said compensating element (40), and wherein said female coupling part (31) is located on said support (48).

10. The coupling according to claim 8, wherein said male coupling part (21) of said sleeve coupling (20) has a distal region and is connected to said support element (60), said male coupling part (21) further comprising an axially displaceable rod (22), a displacement of which causes a radial change of said distal region (26) of said male coupling part (21).

11. The coupling according to claim 10, wherein said distal region (26) of said male coupling part (21) corresponds to a sleeve of said female part (31) having a mouth and a conical taper towards the mouth, arranged on the metallurgical vessel.

12. The coupling according to claim 10, further comprising a piston-cylinder unit (23) having a displacement piston (24), wherein said rod (20) is coupled to said piston (24) and being displaceable within said male coupling part (21) by said piston-cylinder unit (23).

13. The coupling according to claim 12, further comprising a spring (25) arranged between said piston (24) of said piston-cylinder unit (23) and said male coupling part (21).

14. The coupling according to claim 13, further comprising a pump (78) and feed and discharge line (76, 77) connecting said pump (78) to said piston-cylinder unit (23), said pump (78) providing a pressure for displacement of said piston (24).

15. The coupling according to claim 8, further comprising a current tab (32) provided in said sleeve coupling formed by the first electrical coupling (30) and said second electrical coupling (20).

* * * * *